US008888250B2

(12) United States Patent
Law et al.

(10) Patent No.: US 8,888,250 B2
(45) Date of Patent: Nov. 18, 2014

(54) THERMAL BUBBLE JETTING MECHANISM, METHOD OF JETTING AND METHOD OF MAKING THE MECHANISM

(75) Inventors: Kock-Yee Law, Penfield, NY (US); Jun Ma, Penfield, NY (US); Hong Zhao, Webster, NY (US); Peter M. Gulvin, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 185 days.

(21) Appl. No.: 13/555,901

(22) Filed: Jul. 23, 2012

(65) Prior Publication Data

US 2014/0022311 A1 Jan. 23, 2014

(51) Int. Cl.
*B41J 2/05* (2006.01)
*H05B 3/00* (2006.01)

(52) U.S. Cl.
USPC ..... 347/56; 347/65; 347/67; 29/611

(58) Field of Classification Search
None
See application file for complete search history.

(56) References Cited

U.S. PATENT DOCUMENTS

| | | | | |
|---|---|---|---|---|
| 8,348,390 | B2 * | 1/2013 | Law et al. | 347/54 |
| 8,708,458 | B2 * | 4/2014 | Zhao et al. | 347/44 |
| 2012/0044299 | A1 * | 2/2012 | Winger | 347/54 |

OTHER PUBLICATIONS

Zhao et al., "Fabrication, Surface Properties and Origin of Superoleophobicity for a MOdel Textured Surface," American Chemical Society, Langmuir 2011, 27, 5927-5935.

* cited by examiner

*Primary Examiner* — Geoffrey Mruk
(74) *Attorney, Agent, or Firm* — MH2 Technology Law Group LLP

(57) ABSTRACT

A thermal bubble jetting device including a substrate. A superoleophobic, textured surface is positioned on the substrate. The textured surface comprises one or more gaps configured for holding a gas. A receptacle is positioned in fluid communication with the textured surface. Both an inlet and nozzle are in fluid communication with the receptacle. The device includes a heater mechanism configured to expand a gas in the one or more gaps so as to sufficiently increase pressure in the receptacle to force liquid through the nozzle.

20 Claims, 4 Drawing Sheets

THERMAL BUBBLE JETTING MECHANISM, METHOD OF JETTING AND METHOD OF MAKING THE MECHANISM

DETAILED DESCRIPTION

1. Field of the Disclosure

The present disclosure is directed to a thermal jetting mechanism, which can be employed in, for example, an inkjet printhead.

2. Background

In the past, printheads have been made by diffusion bonding stacks of Au plated stainless plates, followed by brazing in a hydrogen environment at a thousand degrees. The front face of the printhead is then modified with a PFA coating to enable sufficient drool pressure for jetting to occur. The printhead works well with solid ink, but the fabrication costs are high.

In order to reduce costs, high-density (HD) Piezo Printheads are being developed which employ a number of plastic layers. While some reduction in costs are projected, there is always a need for further cost reduction to allow inkjets, including those that employ solid inks or other non-aqueous type inks, to be more competitive in the market.

Thermal bubble jets are widely used in office printers that use aqueous inks. The basic mechanism is to use a micro heater to boil the water in the ink to generate enough pressure to produce an ink drop. The printhead is made by photolithographic techniques and the cost is known to be very low.

There remains a need for a novel thermal jetting design that may help to alleviate one or more of the problems associated with known jetting techniques, such as those discussed above for inkjet printheads.

SUMMARY

An embodiment of the present disclosure is directed to a thermal bubble jetting device. The device comprises a substrate. A superoleophobic, textured surface is positioned on the substrate. The textured surface comprises one or more gaps configured for holding a gas. A receptacle is positioned in fluid communication with the textured surface. Both an inlet and nozzle are in fluid communication with the receptacle. The device further comprises a heater mechanism configured to expand a gas in the one or more gaps so as to sufficiently increase pressure in the receptacle to force liquid through the nozzle.

Another embodiment of the present disclosure is directed to a method for jetting. The method comprises providing a jetting device. The jetting device includes a substance to be jetted in a receptacle, a superoleophobic textured surface and a nozzle. The textured surface comprises one or more gas-filled gaps. The gas in the one or more gaps is heated to expand a volume of the gas and thereby force a portion of the substance through the nozzle.

Yet another embodiment of the present disclosure is directed to a method for making a thermal bubble jetting device. The method comprises providing a substrate comprising a superoleophobic, textured surface. The substrate is bonded to a plurality of plates to form a jet stack. A heater mechanism is positioned in the jet stack, the heater being configured to expand a gas in a gap of the textured surface.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate embodiments of the present teachings and together with the description, serves to explain the principles of the present teachings.

Figure 1A:
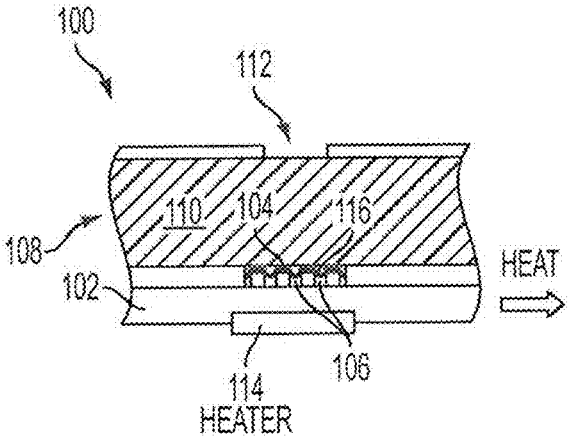
FIGS. 1A and 1B schematically depict a thermal bubble jetting device, according to an embodiment of the present disclosure.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawings that form a part thereof, and in which is shown by way of illustration a specific exemplary embodiment in which the present teachings may be practiced. The following description is, therefore, merely exemplary.

FIG. 1A schematically depicts a thermal bubble jetting device 100, according to an embodiment of the present disclosure. The device 100 includes a substrate 102. A superoleophobic textured surface 104 is positioned on the substrate 102. Textured surface 104 comprises a plurality of gaps 106 and can be positioned in a receptacle 108 that is configured for containing a substance to be jetted, such as, for example, ink 110. A nozzle 112 is positioned so as to be in fluid communication with the receptacle 108. Device 100 also includes a heater mechanism 114 for heating a gas 116 contained in the gaps 106.

The textured surface 104 can comprise any suitable texture that can be made superoleophobic and that is capable of trapping sufficient gas to provide a desired jetting force upon expansion of the gas. In an embodiment, the textured surface 104 comprises alternating high and low surfaces, such as a plurality of ridges or an array of pillars.

The textured surface 104 can comprise any suitable material from which micro/nano-sized textures can be formed and that can provide the desired superoleophobic surface. In an embodiment, the textured surface 104 can comprise a semiconductor material, such as silicon, germanium or gallium arsenide; a metal; and/or an insulator material, such as a polymer or ceramic.

In an embodiment, the textured surface is coated to provide the desired superoleophobicity. Any coating material that can render the surface superoleophobic can be employed. Examples of suitable coating materials can include one or more fluorosilane layers synthesized from tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, and heptadecafluoro-1,1,2,2-tetrahydrooctyltriethoxysilane. The fluorosilane coating can be deposited using any suitable method, such as, for example, molecular vapor deposition, chemical vapor deposition or solution coating techniques.

In an embodiment, the textured surface can comprise a superoleophobic surface forming polymer. Examples include coatings comprising from one or more amorphous fluoropolymer layers. Any polymers suitable for forming a superoleophobic surface can be employed. Examples of suitable fluoropolymers include AF1600 and AF2400, commercially available from DuPont; and perfluoropolyether polymers, such FLUOROLINK-D, FLUOROLINK-E10H or the like, which are available from Solvay Solexis. The amorphous polymers can be coated on a textured surface.

Figure 2:
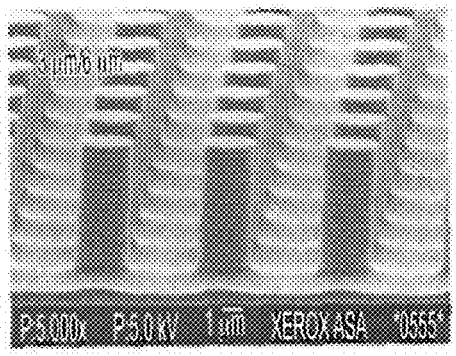
FIG. 2 illustrates an example of a fluoropolymer coated, textured superoleophobic surface.

FIG. 2 illustrates an example array of superoleophobic silicon pillars. It has been shown that liquids, such as water, oil or ink, "sit" on a gas on the superoleophobic pillar array textured surface. When heated, the air trapped by the liquid can expand to provide the desired jetting force.

The inventors of this disclosure have previously reported that superoleophobic surfaces can be fabricated by first creating arrays of pillars on a Si-wafer via photolithography followed by surface fluorination. The resulting surface created exhibited extremely high repellency with water and oil (hexadecane) with contact angles exceeding 150° and sliding angles at 10°, suggesting that these two liquids form a Cassie-Baxter composite state at the solid-liquid interface. See H. Zhao, K. Y. Law and V. Sambhy, Fabrication, "Surface Properties and Origin of Superoleophobicity for a Model Textured Surface," Langmuir, 2011, 27, 5927.

Further work with solid ink by the inventors of the present disclosure now indicates that a molten solid ink drop also forms the Cassie-Baxter state on the pillar array surface. The inventors were able to cool down a wax ink drop and study the composite interface by SEM microscopy. This provided direct evidence that the ink drop sits on air on the superoleophobic surface. It is thought that the ability of the superoleophobic textured surface to trap gas can be useful in providing a sufficient jetting force for printhead operation upon thermal expansion of the gas.

Referring back to FIG. 1A, the dimensions of the textured surface 104 can be varied to provide a desired volume in the space between the pillars, thereby allowing an appropriate amount of gas to be trapped to provide the force for jetting substance 110 from nozzle 112. In an embodiment where the textured surface 104 comprises pillars, the pillars can have a width dimension ranging from, for example, about 0.1 microns to about 10 microns, or about 0.5 microns to about 10 microns, or about 1 micron to about 5 microns. The width dimension can be, for example, a diameter, in the case where the pillar has a circular cross-section, or any width dimension of a polygonal shaped cross-section, such as the case where the cross-section is a rectangle or square. The pillars can have a height dimension ranging from about 0.1 microns to about 100 microns, or about 0.5 microns to about 50 microns, or about 0.5 microns to about 30 microns. The distance between the pillars can also be adjusted by any desired amount to provide a desired volume for trapping the gas. For example, the textured pattern can comprise an array of pillars having a solid area coverage of 0.5% to about 50%, or from about 1% to about 30%, or from 1% to about 20%

The heater 114 can be any suitable type of micro-heater that is capable of being positioned in or near the bottom of the textured surface. In an embodiment, the heater 114 is a resistive heater, such as a heater comprising a semiconductor or metal resistive element. Examples of such heaters are well known in the art.

Figure 3:
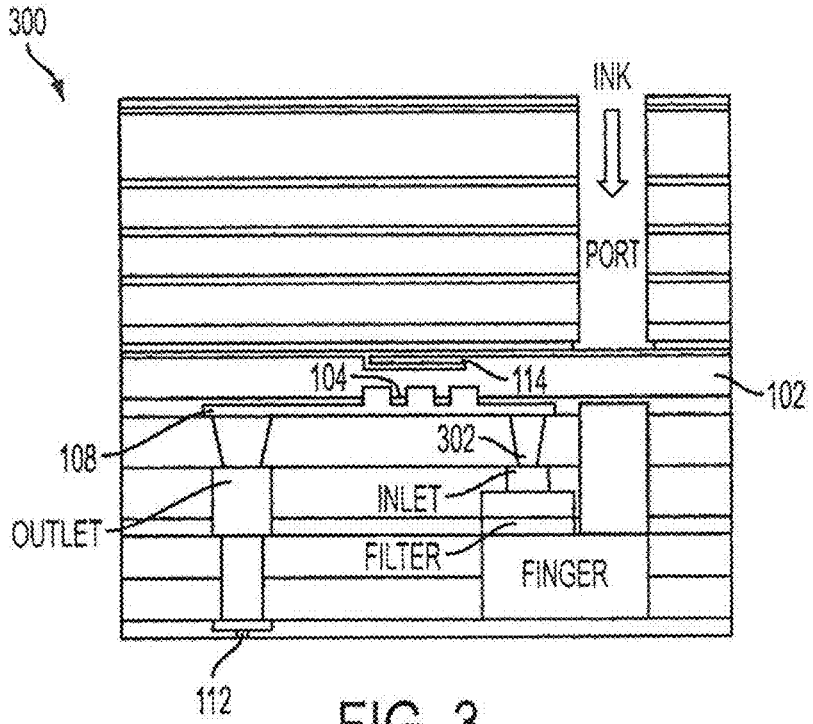
FIG. 3 illustrates an example of a high density print head, according to an embodiment of the present disclosure.

The thermal bubble jetting device shown in FIG. 1A can be employed as an actuator for providing ink jetting force in printheads. One example of such a device is the high density print head 300 illustrated in FIG. 3. The high density printhead 300 comprises a plurality of stacked plates that are bonded together. The plates can comprise metal, semiconductor or plastic or any other material suitable for forming a printhead. Techniques for manufacturing printheads from stacked plates are well known in the art.

In an embodiment, the jet stack comprises an ink receptacle 108, as described above. The ink receptacle 108 can be in fluid communication with an inlet 302 and a nozzle 112. One or more patches of superoleophobic textured surfaces 104 can be positioned in fluid communication with the ink receptacle 108. A heating device 114 can be positioned near each patch. When the ink receptacle is filled with ink, gas bubbles will be formed and trapped by the textured surface. The volume of the trapped gas depends on the dimensions of the textured surface. For example, where the textured surface comprises pillars, the gas volume can depend on pillar diameter, spacing and pillar height, as discussed above.

Figure 1B:
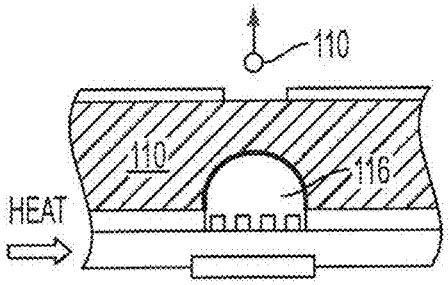

The present disclosure is also directed to a method for jetting. The method comprises providing a jetting device comprising a substance to be jetted in a receptacle, as illustrated by device 100 in FIG. 1A. Gas 116 trapped in the gap 106 expands when heated by heater 114, as shown in FIG. 1B. The increase in gas volume increases pressure and displaces a volume of the substance 110 in the receptacle 108, thereby causing a portion of the substance 110 to be forced through nozzle 112.

The thermal bubble jetting mechanisms of the present disclosure are suitable for jetting any type of substance that is capable of trapping gas in the superoleophobic textured surface so as to be jetted from device 100. In an embodiment, the substance is ink, including aqueous based inks and non-aqueous based inks. In an embodiment, ink 110 can be what is known in the art as a solid, or a waxed based, ink. These inks are solid at room temperature. When the printhead is in use, the ink is generally maintained at a higher temperature, so that the ink is in a molten phase. In yet another embodiment, an ink that is a liquid at room temperature can be used, such as in the case of aqueous based inks or liquid organic solvent based inks. In an embodiment, ink 110 is a UV dryable ink. Liquids other than inks that could be jetted include water or oils.

The gas 116 can be any suitable gas that will expand upon heating to provide the desired jetting force. In general, gases can be chosen that conduct heat relatively well and that provide a reduced risk of explosion or corrosion of the printhead. Examples of such gases include air and inert gases, such as nitrogen and argon.

Heating the gas 116 can be accomplished using any suitable technique that will expand the gas at a rate sufficient to provide the desired jetting force. In an embodiment, the heating is provided by supplying one or more pulses of energy to the gas using heater 114. The pulses can be, for example, on the order of micro-seconds, such as 1 micro-second to about 100 micro-seconds. Initial modeling suggests that pressure comparable to the HD Piezo printhead can be produced by, for example, a 10 micro second 6.94e-4 W/um$^3$ heat pulse.

Figure 4:
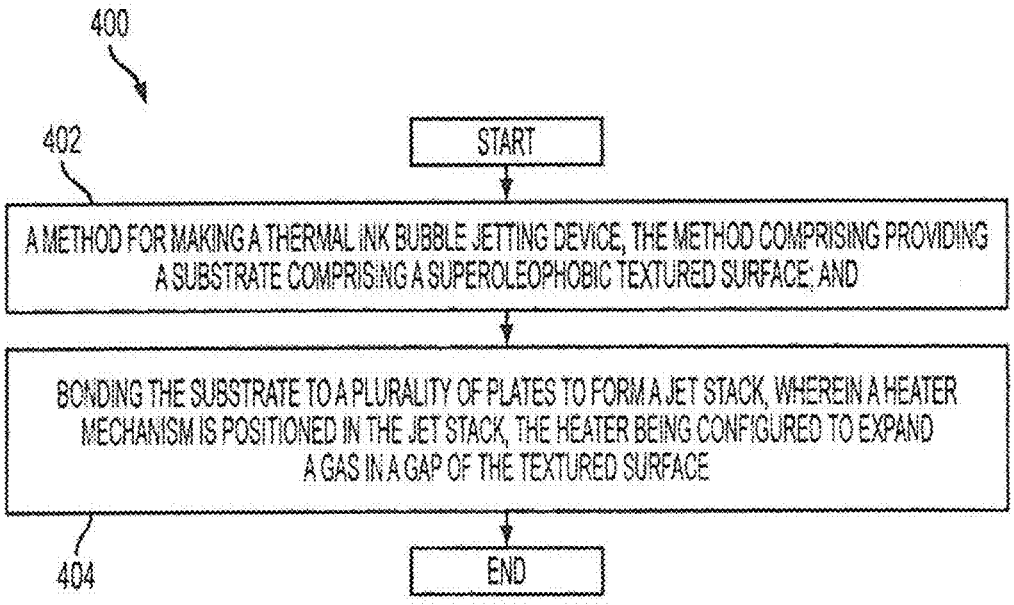
FIG. 4 illustrates a method for making a thermal bubble jetting device, according to an embodiment of the present disclosure.

FIG. 4 illustrates a method 400 for making a thermal bubble jetting device, according to an embodiment of the present disclosure. The method comprises providing a substrate including a superoleophobic, textured surface, as shown at 402 of FIG. 4. The substrate can then be bonded to a plurality of plates to form a jet stack, as shown at 404. A heater mechanism is positioned in the jet stack. The heater is configured to expand a gas in a gap of the textured surface, as discussed above.

In an embodiment, the heater can be fabricated onto the surface of the same substrate on which the textured surface is positioned prior to bonding of the jet stack plates. Alternatively, the heater can be part of a plate that is different from the substrate on which the textured surface is formed. One of ordinary skill in the art would be readily able to incorporate a suitable heater into the jet stack.

In an embodiment, the process for forming the textured surface can include forming a mask on the substrate and selectively etching the substrate. Any suitable masking and etching techniques can be employed. For example, photolithographic techniques for forming masks are well known in the art. Suitable etching techniques are also well known.

Any suitable process for treating the substrate to form a superoleophobic surface on the substrate can be employed. Suitable techniques can include coating the surface with fluoropolymers and/or fluorosilanes, as described above.

In an embodiment, the substrate can be selectively treated to form patches of superoleophobic surfaces thereon. For example, the substrate can be masked using photolithographic techniques prior to treating with a fluorinated material in order to selectively form the desired superoleophobic patches.

Examples

Figure 5:
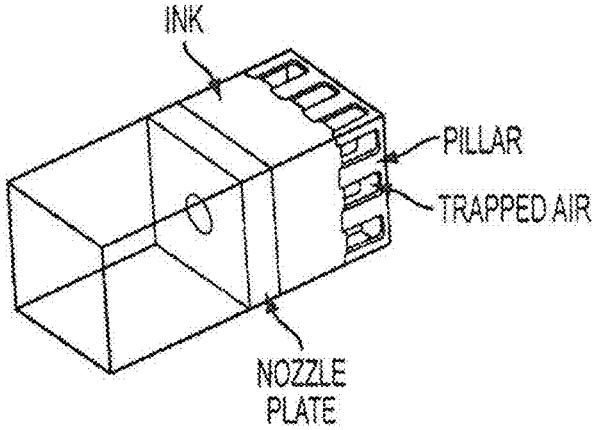
FIG. 5 shows a model with boundary conditions, according to an embodiment of the present disclosure.
Figure 6:
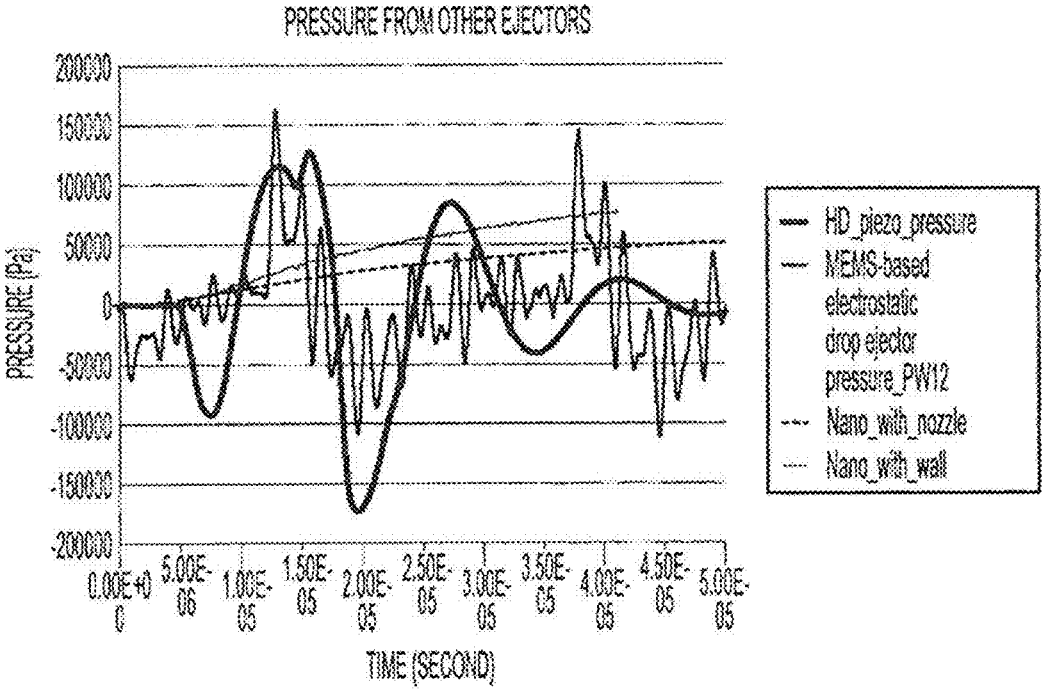
FIG. 6 shows modeling results of a volume increase and pressure change as a result of heating trapped air, for the model illustrated by FIG. 5; as well as a comparison of data for an HD printhead using a PZT actuated diaphragm and a MEMS-based electrostatic drop ejector.
Figure 7A:
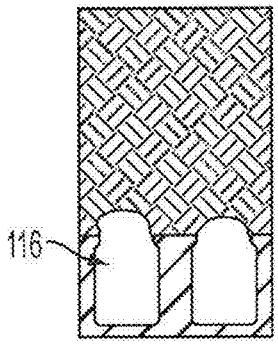
FIGS. 7A and 7B illustrate modeling results for the device of FIG. 5.
Figure 7B:
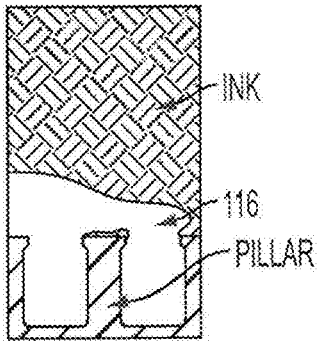

A three dimensional flow model was built to simulate the volume expansion of air trapped by pillars and the corresponding pressure increase. FIG. 5 shows the model with boundary conditions and initial condition of the heat pulse input. FIG. 6 and Table 1, below, show the modeling results of the volume increase and the pressure change as a result of heating the trapped air, as well as a comparison with an HD printhead using a PZT actuated diaphragm and a MEMS-based electrostatic drop ejector. FIGS. 7A and 7B also illustrate results of the modeling. FIG. 7A shows trapped gas 116. FIG. 7B shows the expansion of gas 116 under the simulation conditions. The modeling data, summarized in Table 1 below, indicate that both pressure and volume increases are in the right order for a functional printhead.

TABLE 1

Comparison of Nanojet and functional printheads

| | Nanojet | HD | MEMS |
|---|---|---|---|
| Volume increase (e.g. single drop size) | ~1-100 pL | ~17 pL | ~12 pL |
| Pressure increase (e.g. jetting pressure) | ~0.9 atm | ~1.27 atm | ~1.9 atm |

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A thermal bubble jetting device, comprising:

a substrate;

a superoleophobic, textured surface positioned on the substrate, the textured surface comprising one or more gaps configured for holding a gas;

a receptacle positioned in fluid communication with the textured surface;

an inlet and a nozzle, both the inlet and nozzle being in fluid communication with the receptacle; and a heater mechanism configured to expand a gas in the one or more gaps so as to sufficiently increase pressure in the receptacle to force liquid through the nozzle.

2. The device of claim 1, wherein the textured surface comprises alternating high and low surfaces.

3. The device of claim 1, wherein the textured surface comprises an array of pillars.

4. The device of claim 3, wherein the pillars comprise silicon coated with a fluorinated material.

5. The device of claim 3, wherein the pillars have a width dimension ranging from about 0.1 microns to about 10 microns; and a height dimension ranging from about 0.5 microns to about 50 microns.

6. The device of claim 1, wherein the textured surface is coated with a fluorinated material.

7. The device of claim 6, wherein the fluorinated material is chosen from fluoropolymers, fluorosilanes or mixtures thereof.

8. The device of claim 1, wherein the textured surface comprises a plurality of ridges.

9. The device of claim 1, wherein the receptacle is configured to hold a volume of a substance to be jetted.

10. The device of claim 1, wherein the thermal bubble jetting device is an inkjet printhead.

11. A method for jetting, the method comprising:

providing a jetting device comprising a substance to be jetted in a receptacle, a superoleophobic textured surface and a nozzle, the textured surface comprising one or more gas-filled gaps; and heating the gas in the one or more gaps to expand a volume of the gas and thereby force a portion of the substance through the nozzle.

12. The method of claim 11, wherein the substance is ink.

13. The method of claim 12, wherein the ink is a non-aqueous solvent based liquid.

14. The method of claim 12, wherein the ink is a UV curable ink.

15. The method of claim 11, wherein the gas is chosen from air, an inert gas or mixtures thereof.

16. The method of claim 11, wherein heating the gas comprises providing one or more pulses of energy to the gas.

17. A method for making a thermal bubble jetting device, the method comprising:

providing a substrate comprising a superoleophobic, textured surface; and bonding the substrate to a plurality of plates to form a jet stack, wherein a heater mechanism is positioned in the jet stack, the heater being configured to expand a gas in a gap of the textured surface.

18. The method of claim 17, further comprising forming the textured surface, the process for forming the textured surface comprising forming a mask on the substrate and selectively etching the substrate to form textures.

19. The method of claim 18, wherein the process for forming the array comprises treating the textures with a fluorinated material.

20. The method of claim 17, wherein the jet stack comprises a receptacle, and further wherein one or more patches of the textured surface are positioned in fluid communication with the receptacle.

* * * * *